US005822647A

United States Patent [19]

Sakuraba et al.

[11] Patent Number: 5,822,647

[45] Date of Patent: Oct. 13, 1998

[54] DEVELOPING DEVICE HAVING MEANS FOR PREVENTING TONER SCATTERING

[75] Inventors: Tamotsu Sakuraba; Hirofumi Hasagawa, both of Toyokawa, Japan

[73] Assignee: Minolta Co., Ltd., Osaka, Japan

[21] Appl. No.: 772,905

[22] Filed: Dec. 24, 1996

[30] Foreign Application Priority Data

Dec. 28, 1995 [JP] Japan ..... 7-342680

[51] Int. Cl.[6] ..... G03G 15/00; G03G 15/08

[52] U.S. Cl. ..... 399/27; 399/55; 399/285; 430/120

[58] Field of Search ..... 399/27, 29, 25, 399/55, 270, 272, 281, 285; 430/120

[56] References Cited

U.S. PATENT DOCUMENTS 4,733,267 3/1988 Enoki et al. ..... 399/27
5,220,379 6/1993 Fukuchi et al. ..... 399/25
5,365,318 11/1994 Hiraoka et al. ..... 399/55 X
5,374,977 12/1994 Shiina et al. ..... 399/27
5,572,292 11/1996 Chatani et al. ..... 399/25

*Primary Examiner*—Arthur T. Grimley
*Assistant Examiner*—Sophia S. Chen
*Attorney, Agent, or Firm*—Burns, Doane, Swecker & Mathis, LLP

[57] ABSTRACT

A voltage that has a difference in potential in the polarity direction opposite to the charge of the developer relative to the voltage applied to the sleeve by power supply 34 is applied to the control member by power supply 36. By this use of power supply 36, when the amount of remaining developer has fallen to a prescribed level, the conveyance of the developer to the photosensitive member by the sleeve is prevented, preventing image formation. Therefore, the image formation operation does not continue where the amount of remaining developer is small, which in turn eliminates the scattering of developer and maintains the cleanliness of the interior of the apparatus.

21 Claims, 4 Drawing Sheets

DEVELOPING DEVICE HAVING MEANS FOR PREVENTING TONER SCATTERING

BACKGROUND OF THE INVENTION

1. Field of the Invention

The present invention pertains to a developing device used in an image forming apparatus using the electrophotographic method, such as a copier, printer or facsimile machine.

2. Description of the Related Art

Developing devices are known that are equipped with a developer carrier that rotates, a developer tank, a developer supply member that conveys the developer toward the developer carrier, and a control member that causes the developer carrier to hold the developer by being in contact with the outer surface of the developer carrier and controlling the developer supplied to the developer carrier and that charges the developer such that the developer will have a prescribed polarity. These developing devices develop the electrostatic latent image on the photosensitive member using the developer retained on the outer surface of the developer carrier.

However, in the developing device described above, when there is only a small amount of developer remaining in the developer tank, the developer scatters, causing a background fog on the image, or adhering to and contaminating other internal devices such as the transfer device or fusing device.

Therefore, the time to replace the developing device is indicated by displaying on the operation panel of the copier, printer, etc., when the amount of remaining developer has fallen to a prescribed level, the fact that the amount of remaining developer has become small. However, if image formation were prevented at the time this display is made, it would decrease the machine's ease of use for the user to a great extent. Therefore, the image formation operation can generally be continued even after the display.

Thus the image formation operation continues with a small amount of remaining developer, which has the effect of exacerbating the internal contamination. If parts that cannot be replaced are contaminated, images of adequate quality can no longer be obtained, even where only the developing device is replaced.

SUMMARY OF THE INVENTION

The object of the present invention is to provide a developing device that, by preventing the conveyance of the developer when the amount of remaining developer has fallen to a prescribed level, does not contaminate with scattered developer the interior of the apparatus or other devices located near said developing device.

Another object of the present invention is to provide a developing device that does not cause damage to the image forming apparatus in which the developing device is employed, even if the developing device is not replaced at an indicated time.

Using the device of the present invention, when the amount of remaining developer has fallen to a prescribed level, the conveyance of the developer by the developer carrier is prevented. As a result, the developer is not supplied to the photosensitive member, which prevents the formation of a high quality image. Therefore, because the image formation operation does not continue where the amount of remaining developer is small, the developer does not scatter and the interior of the apparatus is maintained in a clean condition. In addition, since the developer does not contaminate other devices located around the developing device and thus does not cause damage to them, the durability of the image forming apparatus increases.

BRIEF DESCRIPTION OF THE DRAWINGS

These and other objects and features of this invention will become clear from the following description, taken in conjunction with the preferred embodiments with reference to the accompanied drawings in which.

DETAILED DESCRIPTION OF THE PREFERRED EMBODIMENTS

Figure 1:
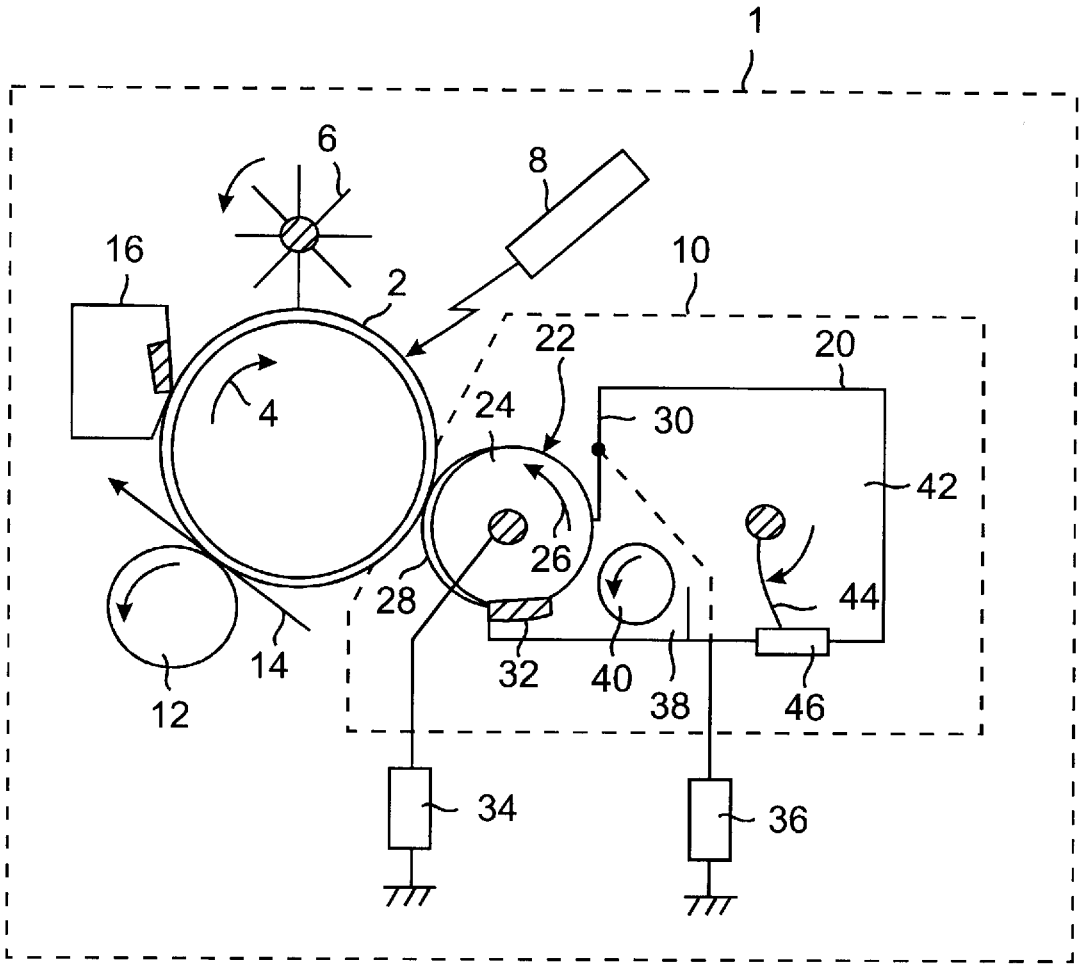
FIG. 1 is a cross-sectional view outlining the construction of an image forming apparatus in which the developing device pertaining to an embodiment of the present invention is employed.

An embodiment of the present invention will be explained with reference to the drawings. FIG. 1 shows the summary construction of major parts of electrophotographic image forming apparatus 1 such as a copier or printer. The summary construction of image forming apparatus 1 will be explained first, together with the image formation operation. Photosensitive member 2, which is an electrostatic latent image carrier, is placed such that it may rotate in the direction of arrow 4 (clockwise in the drawing). Charger 6 is located such that it is in contact with the outer surface of photosensitive member 2, and charges this outer surface such that it will have a prescribed polarity and potential. An electrostatic latent image is formed on the charged photosensitive member 2 when photosensitive member 2 is irradiated with imaging light from exposure device 8 such as a laser device. The electrostatic latent image thus formed is developed into a developer image by developing device 10. The developer image is transferred by transfer device 12 onto transfer medium 14 such as paper, and the transferred image is fused onto the transfer medium by means of a fusing device not shown in the drawing. Meanwhile, the residual developer on photosensitive member 2 is removed by cleaning device 16.

Developing device 10 pertaining to the embodiment of the present invention will now be explained. Developing device 10 is a so-called cartridge type, which is replaced with a new one when the developer housed inside has been consumed. In the drawing, the part indicated by dotted line 10 is a replaceable cartridge. This developing device 10 has housing 20, on which is located developing roller 22 at a position that faces photosensitive member 2 with a slight gap between developing roller 22 and photosensitive member 2. Developing roller 22 has drive roller 24, which rotates in the direction of arrow 26. Flexible sleeve 28 is placed over drive roller 24, said sleeve 28 having a circumference slightly larger than the circumference of drive roller 24.

This sleeve 28 is pressed, by guides not shown in the drawing, against drive roller 24 at either edge of said roller on the side of the roller opposite to the side that faces photosensitive member 2. The deformed section of sleeve 28 that is thereby formed on and separates from the opposite site side of said roller is in contact with the outer surface of photosensitive member 2. The free end of control member 30, the other end of which is fixed to housing 20, is in contact with sleeve 28 on the side that is not facing photosensitive member 2, between the guides described above. Developer leak prevention pad 32 is in contact with the lower part of sleeve 28. Developing bias power supply 34 is connected to sleeve 28 such that a developing bias voltage may be applied to it, while control bias power supply 36 is connected to control member 30 such that a control bias voltage may be applied to it.

Buffer chamber 38 is formed behind developing roller 22 (on the right-hand side in the drawing), and developer supply member 40 to convey the developer toward sleeve 28 is housed in said buffer chamber 38. Developer supply chamber 42 is formed behind buffer chamber 38, and developer churning member 44 is housed in said developer supply chamber 42. Pressure sensor 46, a developer amount detection device, is placed at the bottom of developer supply chamber 42 in order to detect the amount of developer remaining at the bottom of said developer supply chamber 42.

In developing device 10 described above, the developer is housed in developer supply chamber 42 and is supplied to buffer chamber 38 while being churned by churning member 44. The developer in buffer chamber 38 is sent to sleeve 28 by developer supply member 40. Sleeve 28 rotates with drive roller 24 by means of drive roller 24 rotating in the direction of arrow 26, and conveys the developer in buffer chamber 38 that is in the vicinity of said sleeve 28 in the direction of the rotation (the direction of arrow 26). The amount of developer thus conveyed is controlled by control means 30, and a thin layer of developer is formed on the outer surface of sleeve 28 that has passed the contact part of control member 30. The developer also becomes charged with a prescribed polarity via its contact with control member 30. A developing bias voltage that has the same polarity as the polarity of the charge of the developer is applied to sleeve 28 by developing bias power supply 34, while a control bias voltage that has the same polarity as the charge of the developer and that has a difference in potential in the same polarity direction as the charge of the developer relative to the developing bias voltage is applied to control member 30 by control bias power supply 36. Specifically, for example, if the developer becomes charged with a negative polarity, −300 V is applied as developing bias voltage and −550 V is applied as control bias voltage.

The developer that has passed the contact part of control member 30 is conveyed in the direction of arrow 26 by sleeve 28 and is used for the developing of the electrostatic latent image at the part facing photosensitive member 2. Said developing is performed based on the difference in potential between the electrostatic latent image and the developing bias voltage. Since the principle of this developing process is well-known, its explanation will be omitted here. The developer that has passed the part facing photosensitive member 2 is sent back to buffer chamber 38. In addition, developer is supplied to the area of sleeve 28 on which developer was consumed for the developing of the electrostatic latent image.

Figure 2:
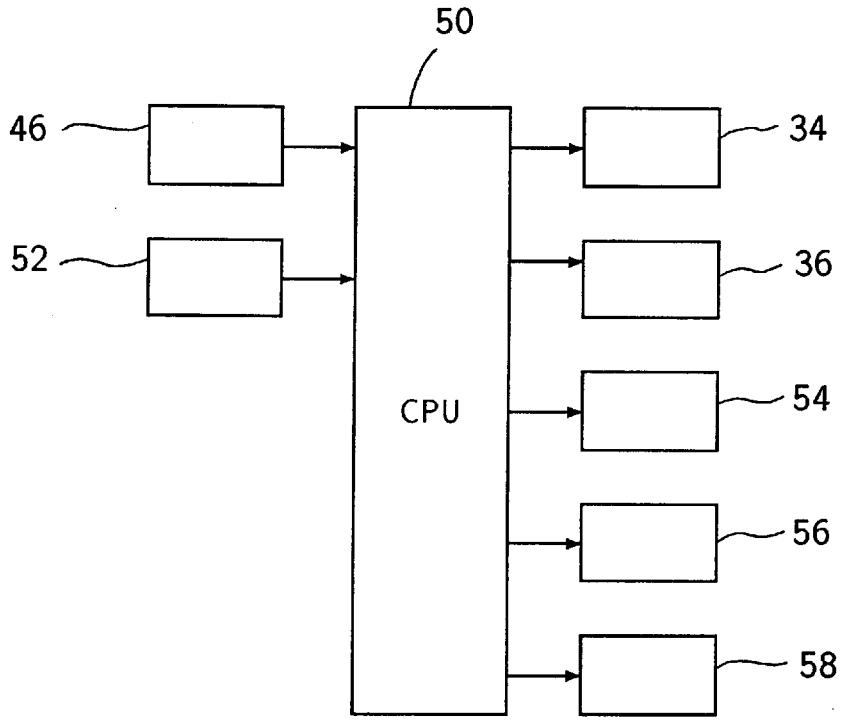
FIG. 2 is a block diagram showing the control circuit of said developing device.

The process of discontinuation of the image formation when the amount of remaining developer housed in developing device 10 has fallen to a prescribed level will now be explained. This image formation discontinuation process is carried out by the control circuit of the developing device shown in FIG. 2. The control circuit has central processing unit (CPU) 50, to which are input signals from pressure sensor 46 and counter 52 that counts the number of images formed using developing device 10, and which outputs signals to developing bias power supply 34, control bias power supply 36, message panel 54 on the image forming apparatus main unit, drive motor 56 for developer supply member 40 and developer churning member 44, and clutch 58 that turns ON and OFF the link between this motor 56 and developer supply member 40 and/or developer churning member 44.

Figure 3:
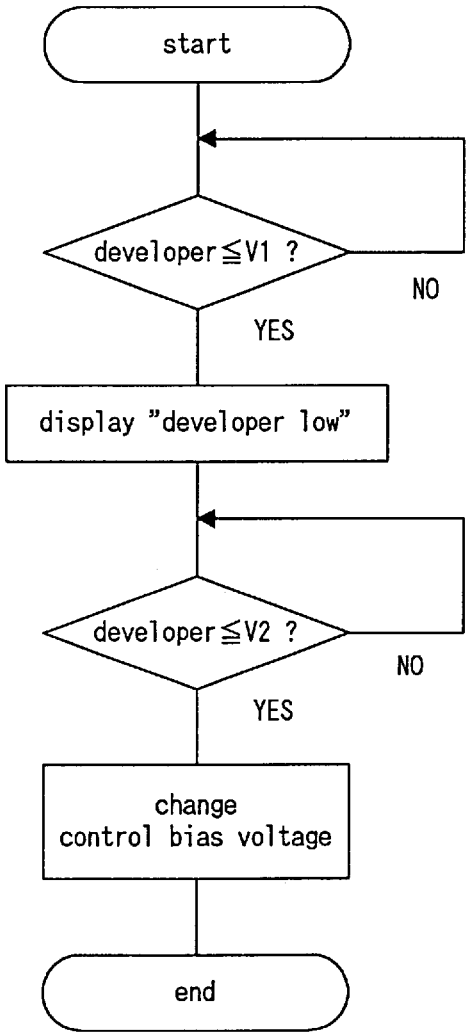
FIG. 3 is a flow chart for the control of the conveyance of the developer in said developing device.

The image formation discontinuation process using the construction described above will be explained with reference to FIG. 3. CPU 50 detects the amount of developer in developer supply chamber 42, i.e., the amount of remaining developer, based on a signal from pressure sensor 46. It then determines whether or not the detected amount of remaining developer is at or below prescribed level V1. If it is at or below prescribed level V1, CPU 50 displays on message panel 54 that the amount of remaining developer is small (Developer Low), urging the user to replace developing device 10. Where the amount of remaining developer is not at or below prescribed level V1, this determination is repeatedly carried out. When this process is taking place, there is little scattering of developer. Therefore, the developing bias voltage and control bias voltage are maintained at −300 V and −550 V, respectively.

It is then determined whether or not the amount of remaining developer detected by pressure sensor 46 is at or below prescribed level V2, which is smaller than prescribed level V1. If the amount of remaining developer is at or below prescribed level V2, it is determined that the developing device has continued to be used without being replaced and that the critical level of developer that will lead to a sudden increase in the scattering of said developer has been reached, and CPU 50 switches the control bias voltage. In other words, CPU 50 changes the output of control bias power supply 36, i.e., the control bias voltage, to a voltage that has a difference in potential in the polarity direction opposite to the charge of the developer relative to the developing bias voltage. For example, if the developing bias voltage is −300 V, the control bias voltage is changed to the grounded voltage, i.e, 0 V. As a result, after the switching of the control bias voltage, the developer charged to have a negative polarity after passing the contact part of control member 30 is electrically attracted to control member 30, which has a positive potential relative to the developing bias voltage, and adheres to said control member 30. The developer that adheres in this way becomes bonded to control member 30 via the friction between control member 30 and sleeve 28. As the bonding of developer onto control member 30 progresses, the amount of developer that passes the contact part of control member 30 decreases, and at the same time the amount of developer that adheres to the electrostatic latent image decreases, which reduces the darkness of the image. If image formation is performed in this condition, only light images can be obtained as image output, and therefore the need to replace the developing device may be discerned.

Figure 4:
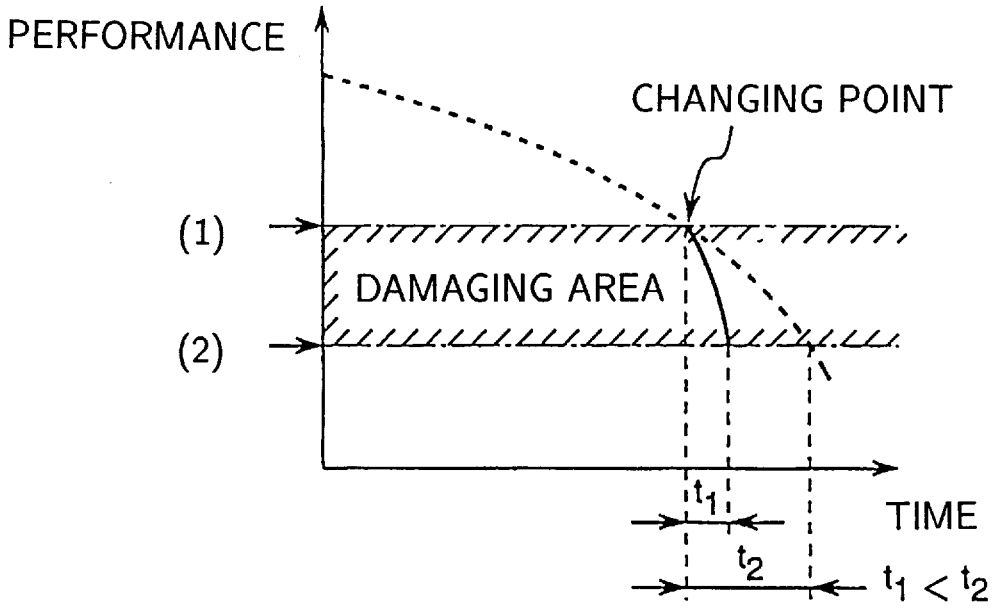
FIG. 4 is a drawing to explain the concept of the present invention.

FIG. 4 shows the concept of the present invention. The horizontal axis shows the length of the period of use of the developing cartridge and the vertical axis indicates the performance level of the developing cartridge. The point on the vertical axis that is indicated by the number (1) indicates the end of the life of the developing cartridge, i.e., the point beyond which the use of the developing cartridge is not desirable. The point indicated by the number (2) indicates the point at which the developing cartridge can no longer serve its purpose. The longer the developing cartridge is used, the more its performance deteriorates. With a conventional developing device, the image forming apparatus continues to be used over a long period of time, i.e., time t2, even after the performance of the cartridge has reached point (1) described above, and as a result damage is often caused to the apparatus (see dotted line).

However, using the developing device of the present invention, because it is intentionally designed such that its performance will deteriorate in the manner described above, time t1 from the start of bonding of developer until the point at which image reproduction is no longer possible is very short (see solid line). Consequently, the damage caused to the main unit of the image forming apparatus can be reduced to a great extent in comparison with conventional models.

When the control bias voltage is changed in the manner of the embodiment described above, in order to reduce the conveyance of the developer, it is not necessary to have another mechanism to stop developer supply member 40 and developer churning member 44, which allows for a simple construction of the device and therefore a lower manufacturing cost.

While the amount of remaining developer is detected using pressure sensor 46 in the embodiment described above, the method of detection is not limited to this. Devices that detect the load, or torque, of developer churning member 44, optical developer amount detection devices, and other known developer amount detection devices may all be used regardless of the type of the detection device.

Further, while the conveyance of the developer by sleeve 28 is prevented by switching the control bias voltage applied to control member 30 in the embodiment described above, it is also acceptable to prevent the conveyance of developer by sleeve 28 by having CPU 50 stop the driving of motor 56 for developer supply member 40 and developer churning member 44, or maintain clutch 58 in the OFF state when the amount of developer has fallen to a prescribed level.

Where developer supply member 40 and developer churning member 44 exert a larger influence on the conveyance of the developer than a change in the control bias voltage, i.e., where developer supply member 40 is in contact with sleeve 28 or where the developing device is placed face up, for example, the time before printing becomes no longer possible can be further reduced by stopping the rotations of developer supply member 40 and of developer churning device 44 instead of changing the control bias voltage, and therefore damage to the main unit of the image forming apparatus can be further reduced.

It is also acceptable if the amount of remaining developer is presumed based on the number of images formed as counted by counter 52. In other words, it is acceptable if it is determined that a prescribed amount of developer has been consumed and the conveyance of the developer is prevented when the number of images formed that is counted by counter 52 has reached a prescribed value.

In addition, while developing device 10 comprises a replaceable cartridge in the embodiment described above, it is acceptable if the entire area, including photosensitive member 2, charger 6 and cleaning device 16, is made replaceable so long as developing device 10 is replaceable.

Obviously, many modifications and variation of the present invention are possible in light of the above teachings. It is therefore to be understood that within the scope of the appended claims, the invention may be practiced other than as specifically described.

What is claimed is:

1. A developing device, comprising:

a developer chamber in which developer is housed;

a developer supplier which supplies the developer from the developer chamber to a predetermined member;

a control member which charges the developer with a prescribed polarity;

a detector which detects a predetermined condition with a developer amount, said predetermined condition being one of an amount of remaining developer falling to a prescribed value and an amount of consumed developer reaching a prescribed value;

a controller which reduces the developer being supplied by electrical attraction to the predetermined member in response to the detection of the condition.

2. A developing device as claimed in claim 1, wherein said controller changes a bias voltage which is applied to the control member.

3. A developing device as claimed in claim 1, wherein said predetermined condition is that an amount of remaining developer falls to a prescribed value.

4. A developing device as claimed in claim 1, wherein said predetermined condition is that an amount of consumed developer reaches a prescribed value.

5. A developing device as claimed in claim 1, wherein said detector detects first and second conditions with the developer amount and said controller prevents the developer from being supplied at the second condition.

6. A developing device as claimed in claim 5, wherein said controller gives a caution to a user.

7. A developing device as claimed in claim 1, wherein said developer chamber and said supplier are structured in a unit.

8. A developing device, comprising:

a developer chamber in which developer is housed;

a developer supplier which supplies the developer from the developer chamber to a predetermined member;

a detector which detects first and second predetermined conditions with a developer amount said first predetermined condition is that an amount of remaining developer falls to a first prescribed value, and said second predetermined condition is that an amount of remaining developer falls to a second prescribed value;

a controller which prevents the developer from being supplied by stopping the developer supplier in response to the detection of the second predetermined condition.

9. A developing device as claimed in claim 8, wherein said controller gives a caution to a user.

10. A developing device as claimed in claim 8, wherein said developer chamber and said supplier are structured in a unit.

11. A developing device, comprising:

a developing cartridge including a developer chamber in which developer is housed and a developer supplier which supplies the developer from the developer chamber to a predetermined member;

a detector which detects a performance level of the developing cartridge;

a controller which deteriorates the performance level of the developing cartridge when the detected performance level reaches a predetermined level.

12. A developing device, comprising:

a developer chamber in which developer is housed;

a developer supplier which supplies the developer from the developer chamber to a predetermined member;

a control member which charges the developer with a prescribed polarity;

a detector which detects a predetermined condition with a developer amount;

a controller which reduces developer being supplied to the predetermined member by changing a difference in potential between said predetermined member and said control member such that the developer is more electrically attracted to said control member than to said predetermined member.

13. A developing device, comprising:

a developer chamber in which developer is housed;

a developer supplier which supplies the developer from the developer chamber to a predetermined member;

a control member which charges the developer with a prescribed polarity;

a detector which detects a predetermined condition with a remaining developer amount, said detector detects first and second conditions with the developer amount; and a controller which reduces the developer being supplied by electrical attraction to the predetermined member in response to the detection of the second condition.

14. A developing device, comprising:

a developer chamber in which developer is housed;

a developer supplier which supplies the developer from the developer chamber to a predetermined member;

a control member;

a detector which detects a predetermined condition with the developer amount; and means for reducing an amount of developer on the predetermined member by electrically attracting the developer to the control member in response to detection of the predetermined condition.

15. A control method for a developing device which supplies a developer from a developer chamber to a predetermined member, said control method comprising the following steps of:

a first step of detecting a predetermined condition with a developer amount, said predetermined condition being one of an amount of remaining developer falling to a prescribed value and an amount of consumed developer reaching a prescribed value; and a second step of reducing the developer charged with a prescribed polarity being supplied by electrical attraction.

16. A control method as claimed in claim 15 wherein said predetermined condition is that an amount of remaining developer falls to a prescribed value.

17. A control method as claimed in claim 15 wherein said predetermined condition is that an amount of consumed developer reaches a prescribed value.

18. A control method as claimed in claim 15 wherein said second step includes a step of changing a bias voltage applied to a member which charges the developer with a prescribed polarity.

19. A control method for a developing device which supplies a developer by a developer supplier from a developer chamber to a predetermined member, said control method comprising the following steps of:

a first step of detecting first and second predetermined conditions with a developer amount, said first predetermined condition is that an amount of remaining developer falls to a first prescribed value, and said second predetermined condition is that an amount of remaining developer falls to a second prescribed value; and a second step of preventing the developer from being supplied by stopping the developer supplier in response to a detection of the second predetermined condition.

20. A control method for a developing device which supplies a developer by a developer supplier from a developer chamber to a predetermined member, said control method comprising the following steps of:

a first step of detecting a first condition with a remaining developer amount;

a second step of detecting a second condition with a remaining developer amount which is different from the first condition; and a third step of reducing the developer being supplied.

21. A control method as claimed in claim, wherein said first step further comprising a step of giving a caution to a user that the first condition is detected.

* * * * *